US005481272A

United States Patent [19]

Yarsunas

[11] Patent Number: 5,481,272

[45] Date of Patent: Jan. 2, 1996

[54] CIRCULARLY POLARIZED MICROCELL ANTENNA

[75] Inventor: George D. Yarsunas, Indian Mills, N.J.

[73] Assignee: Radio Frequency Systems, Inc., Marlboro, N.J.

[21] Appl. No.: 420,439

[22] Filed: Apr. 10, 1995

Related U.S. Application Data

[63] Continuation of Ser. No. 119,710, Sep. 10, 1993, abandoned.

[51] Int. Cl.[6] ..... H01Q 2/26

[52] U.S. Cl. ..... 343/797; 343/789; 343/795; 343/872

[58] Field of Search ..... 343/789, 795, 343/797, 700 MS; H01Q 21/26

[56] References Cited

U.S. PATENT DOCUMENTS

| | | | |
|---|---|---|---|
| 2,412,090 | 12/1946 | Kibler | 343/797 |
| 3,701,157 | 10/1972 | Uhrig | 343/708 |
| 3,740,754 | 6/1973 | Epis | 343/797 |
| 3,854,140 | 12/1974 | Runghelli et al. | 343/814 X |
| 4,062,019 | 12/1977 | Woodward et al. | 343/797 |
| 4,218,685 | 8/1980 | Ellis, Jr. | 343/727 |
| 4,477,813 | 10/1984 | Weiss | 343/700 MS |
| 4,710,775 | 12/1987 | Coe | 343/793 X |
| 5,274,391 | 12/1993 | Connolly | 343/814 X |

OTHER PUBLICATIONS

Johnson, *Antenna Engineering Handbook,* 1984, pp. 23–2–23–17.

Hall et al, *The ARRL Antenna Book,* 15th edition, 1988, pp. 2–12–2–24, pp. 19–8–19–10.

Hall et al, *The ARRL Antenna Book,* 1983, pp. 2–9, 5–7–5–22.

Moxon, "HF Antennas for all Locations," 1984, p. 41.

Simple Antenna for Circular Polarisation, IEE Proceedings Part H, vol. 139, No. 2, Apr., 1992, Stevenage, Herts., GB.

*Primary Examiner*—Donald T. Hajec
*Assistant Examiner*—Steven Wigmore
*Attorney, Agent, or Firm*—Ware, Fressola, Van Der Sluys & Adolphson

[57] ABSTRACT

A circularly polarized microcell antenna 10 that requires only a single feed-line to radiate circularly polarized electromagnetic energy therefrom. The antenna 10 comprises a reflector box 14 having a bottom 15 and side walls 17 to which an electrical connector 20 is mounted. The center conductor 24 of the connector 20 is electrically connected to a conductor bar 22 upon which a first dipole assembly is mounted at a designated one-quarter wavelength location. The shell of the connector 20 is electrically connected to the reflector box 14 upon which a second dipole assembly is mounted at a designated one-quarter wavelength location. Each dipole assembly comprises a primary dipole arm 52 and a secondary dipole arm 68 which are electrically connected by a phasing loop that introduces a 90° phase shift between the primary dipole arm 52 and the secondary dipole arm 68. Thus, a single feed-line is capable of feeding both the primary and secondary dipoles so as to allow circularly polarized electromagnetic energy to radiate therefrom.

20 Claims, 11 Drawing Sheets

CIRCULARLY POLARIZED MICROCELL ANTENNA

This is a continuation of application Ser. No. 08/119,710 filed on Sep. 10, 1993, now abandoned.

1. Field of the Invention

The present invention relates to circularly polarized antennae and, more particularly, to a circularly polarized microcell antenna that requires only a single feed-line to radiate circularly polarized electromagnetic signals from a pair of crossed dipoles.

2. Description of the Prior Art

The use of cellular telephone communication systems has increased dramatically in recent years. In conjunction with this increased use, the number of cellular telephone transmission sites has also increased. Associated with each cellular telephone transmission site are a number of antennae for transmitting signals in the cellular telephone frequency band of the electromagnetic spectrum. It is common in the cellular telephone communications industry for these antennae to transmit these signals in a circularly polarized manner.

Circular polarization of electromagnetic signals transmitted from cellular telephone antennae may be achieved with a pair of crossed, one-half wavelength, dipoles that are fed with equal currents from a synchronous source so as to result in quadrature phasing. The standard method of feeding these dipole pairs is to run a separate feed-line to each dipole pair, with the two feed-lines having a 90° phase length difference between them. However, running a separate feed-line to each dipole pair can be both cumbersome and costly with regard to equipment expenditures and maintenance. It also reduces the impedance bandwidth of the antenna.

It would be desirable to overcome the above-mentioned shortcomings of using separate feed-lines for each dipole pair in the generation of circularly polarized electromagnetic signals. Accordingly, a circularly polarized antenna that requires only a single feed-line in the generation of circularly polarized electromagnetic signals would be desirable.

SUMMARY OF THE INVENTION

The present invention contemplates a circularly polarized microcell antenna employing a pair of crossed dipoles that are fed through a single feed-line. This antenna comprises a pair of crossed dipoles and a pair of phase loop elements which are mounted in a reflector box. The reflector box is connected to a single feed-line through a connector, and the reflector box is impedance matched with the connector. The primary dipole in the pair of crossed dipoles is electrically connected to the reflector box at designated one-quarter wavelength locations. The secondary dipole in the pair of crossed dipoles is electrically connected to the primary dipole via the phase loop elements. The phase loop elements are connected between the pair of crossed dipoles to obtain the required quadrature phasing.

From the above descriptive summary, it is apparent how the present invention circularly polarized microcell antenna overcomes the shortcomings of the above-mentioned prior art.

Accordingly, the primary objective of the present invention is to provide a circularly polarized microcell antenna that employs a pair of crossed dipoles which are fed through a single feed-line so as to radiate circularly polarized electromagnetic signals.

Other objectives and advantages of the present invention will become apparent to those skilled in the art upon reading the following detailed description and claims, in conjunction with the accompanying drawings which are appended hereto.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

PREFERRED EMBODIMENT OF THE PRESENT INVENTION

Figure 2:
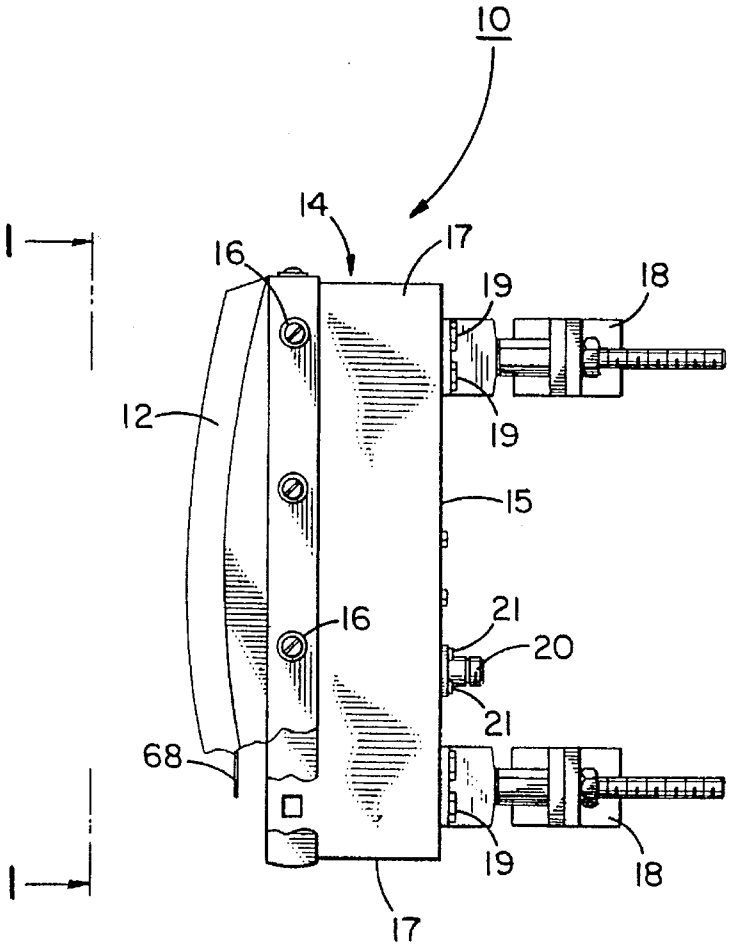
FIG. 2 is a partial breakaway side view of the fully assembled circularly polarized microcell antenna shown in FIG. 1, taken along line 2—2 of FIG. 1.
Figure 1:
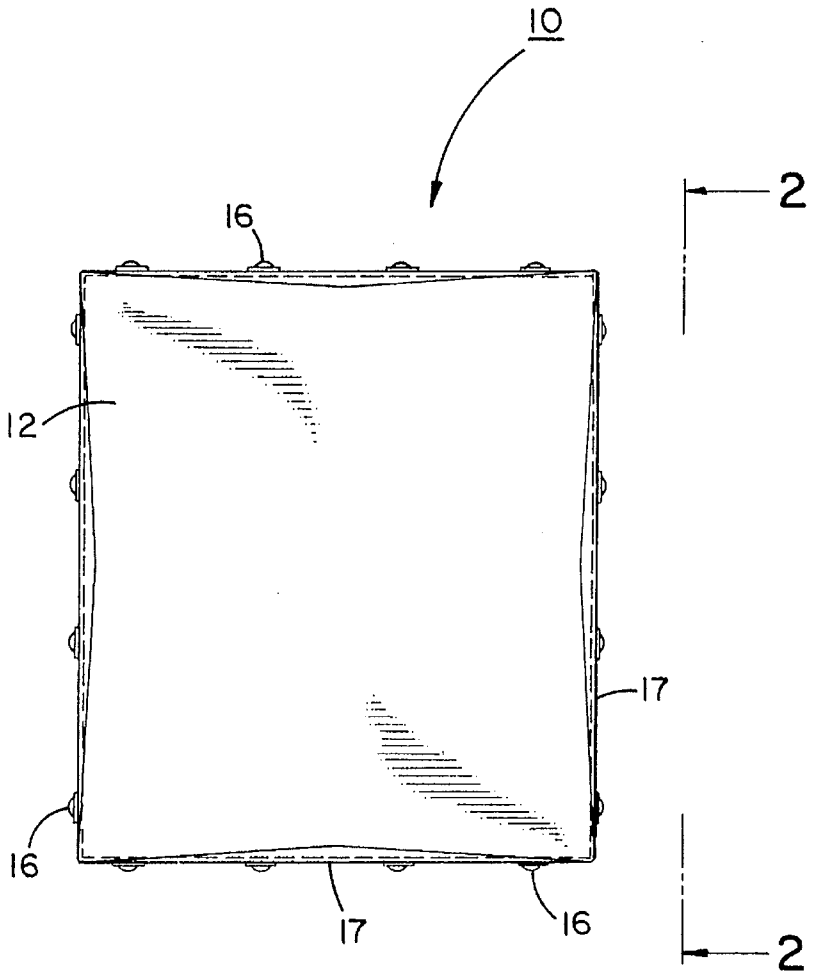
FIG. 1 is a top view of a fully assembled circularly polarized microcell antenna according to the present invention taken along line 1—1 of FIG. 2.

Referring to FIGS. 1 and 2, there is shown a top and a side view, respectively, of a fully assembled circularly polarized microcell antenna 10 according to the present invention. In these views, the antenna 10 is shown having a radome 12 that is secured to a reflector box 14 (having a bottom 15 and side walls 17) by a plurality of mounting screws 16. The radome 12 is secured to the reflector box 14 in this manner so as to shield the inside of the box 14 from the elements, since the antenna 10 is generally deployed outdoors. Inside the reflector box 14, covered by the radome 12, a pair of crossed dipoles are mounted (see FIGS. 3 and 4). Secured to the bottom of the reflector box 14 are a pair of mounting brackets 18 and an electrical connector 20. The mounting brackets 18 are used to secure the antenna 10 at a transmission site, generally a transmission tower. The electrical connector 20, typically a coaxial connector, allows a single feed-line to be electrically connected to the pair of crossed dipoles. The mounting brackets 18 are secured to the reflector box 14 with bolts 19, while the electrical connector 20 is secured to the reflector box 14 with screws 21.

Figure 4:
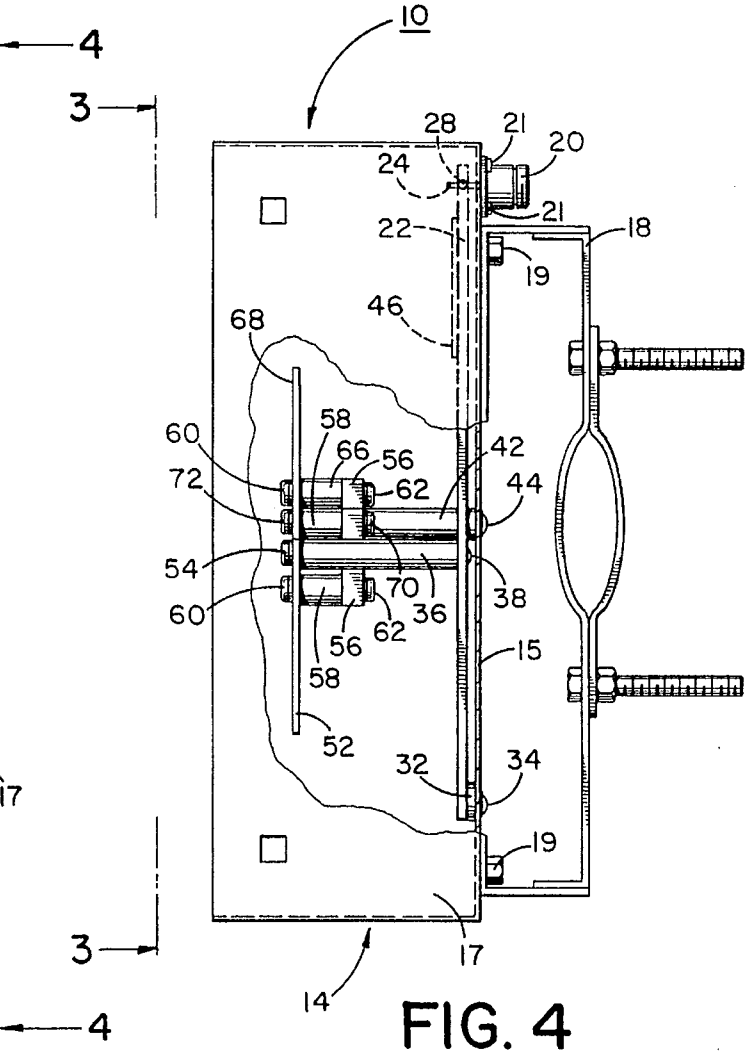
FIG. 4 is a partial breakaway side view of the circularly polarized microcell antenna shown in FIG. 3, taken along line 4–4 of FIG. 3.
Figure 3:
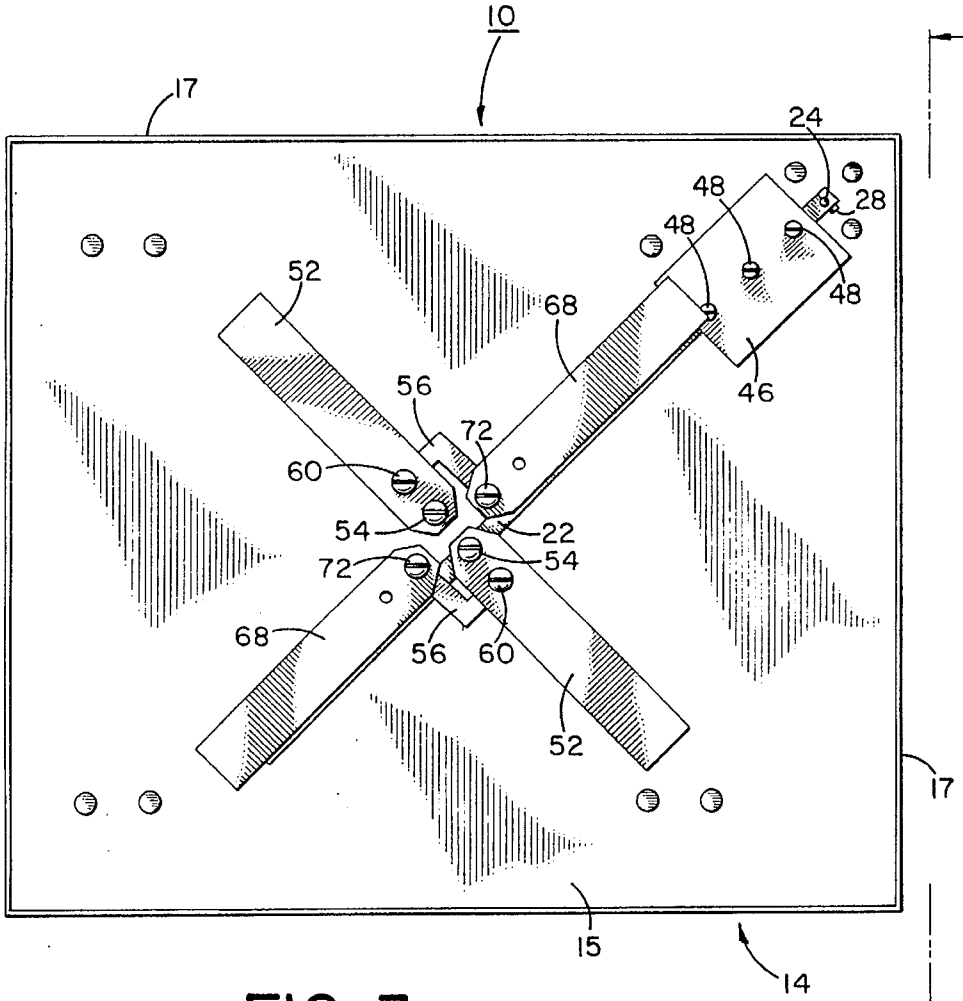
FIG. 3 is a top view of the circularly polarized microcell antenna shown in FIG. 1 with the radome removed, taken along line 3—3 of FIG. 4.

Referring to FIGS. 3 and 4, there is shown a top and a side view, respectively, of the circularly polarized microcell antenna 10 with the radome 12 removed. In these views, the antenna 10 is shown having a conductor bar 22, typically a microstrip line conductor, that is electrically connected at one end to the center conductor 24 of the electrical connector 20. This electrical connection is made by mating the center conductor 24 with a hole 26 (see FIG. 7) which has been vertically bored through the conductor bar 22, and then securing the center conductor 24 within the hole 26 by tightening a set screw 28 against the center conductor 24. The set screw 28 is positioned in a threaded hole 30 (see FIG. 8) which has been horizontally bored into the side of the conductor bar 22 such that it is intersecting with the hole 26. The other end of the conductor bar 22 is secured to the reflector box 14 through a spacer 32 with a screw 34. The screw 34 mates with a threaded hole 35 (see FIG. 7) which has been vertically bored through the conductor bar 22. The spacer 32, along with all the other components in the antenna 10 except thee radome 12 which is preferably made of fiberglass, is made of an electrically conductive material, preferably irridited aluminum. Thus, an electrical connection is made between the conductor bar 22 and the reflector box 14 through the spacer 32.

Figure 11:
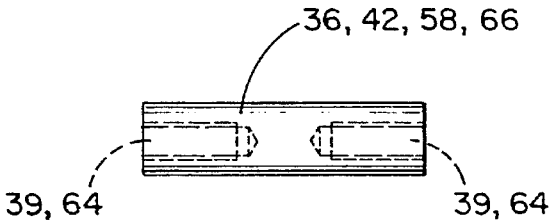
FIG. 11 is a side view of a standoff used in the circularly polarized microcell antenna shown in FIG. 1, taken along line 11—11 of FIG. 12.
Figure 12:
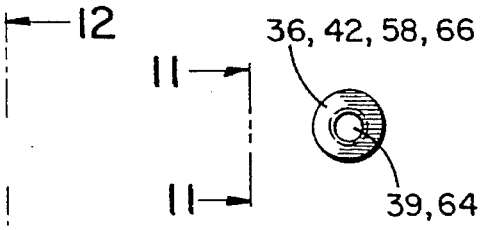
FIG. 12 is an end view of the standoff shown in FIG. 11, taken along line 12—12 of FIG. 11.

Near the center of the conductor bar 22, a countersunk hole 40 (see FIG. 7) is vertically bored through the conductor bar 22 such that one end of a first standoff 36 may be secured thereto with a screw 38 without electrical contact being made with the reflector box 14. Near the center of the reflector box 14, alongside where the first standoff 36 is secured to the conductor bar 22, one end of a second standoff 42 is secured to the reflector box 14 with a screw 44. Both ends of the first standoff 36 and the second standoff 42 have threaded holes 39 (see FIGS. 11 and 12) formed therein which allow the screws 38, 44, respectively, to mate therewith. Since, as previously described, the components in the antenna 10 are made of an electrically conductive material, an electrical connection is made between the first standoff 36 and the conductor bar 22 and between the second standoff 42 and the reflector box 14.

At this point it should be noted that the shell casing of the electrical connector 20 is electrical ground, and the electrical connector 20 is secured to the reflector box 14 so as to form an electrical connection therebetween. Thus, the reflector box 14 is considered to be an electrical ground with respect to the center conductor 24. It should also be noted that the first standoff 36 and the second standoff 42 are secured at designated one-quarter wavelength locations on the conductor bar 22 and the reflector box 14, respectively, with respect to a standing wave that is generated along the conductor bar 22, and hence within the reflector box 14, from a signal supplied by the single feed-line. Thus, the first standoff 36 and the second standoff 42 are secured to the conductor bar 22 and the reflector box 14, respectively, at locations where the voltage component of the standing wave is at its peak. It should further be noted that the electrical connector 20, and hence the single feed-line, typically have a characteristic impedance of 50 Ω. To match this impedance, a trim element 46 is secured to the conductor bar 22 so as to act as a capacitor or an impedance transformer in bringing the impedance of the antenna 10 in conformance with that of the electrical connector 20. The trim element 46 is secured to the conductor bar 22 with several screws 48. The screws 48 mate with corresponding threaded holes 50 (see FIG. 7) which have been vertically bored into the conductor bar 22.

Figure 6:
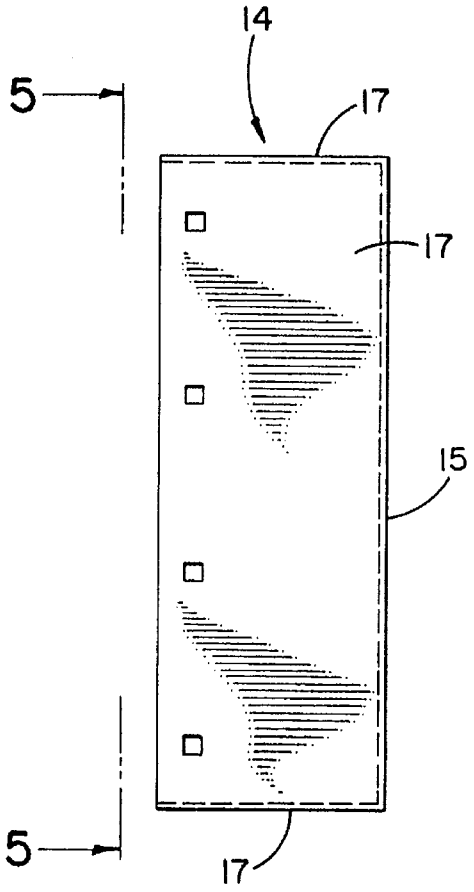
FIG. 6 is a side view of the reflector box shown in FIG. 5, taken along line 6—6 of FIG. 5.
Figure 5:
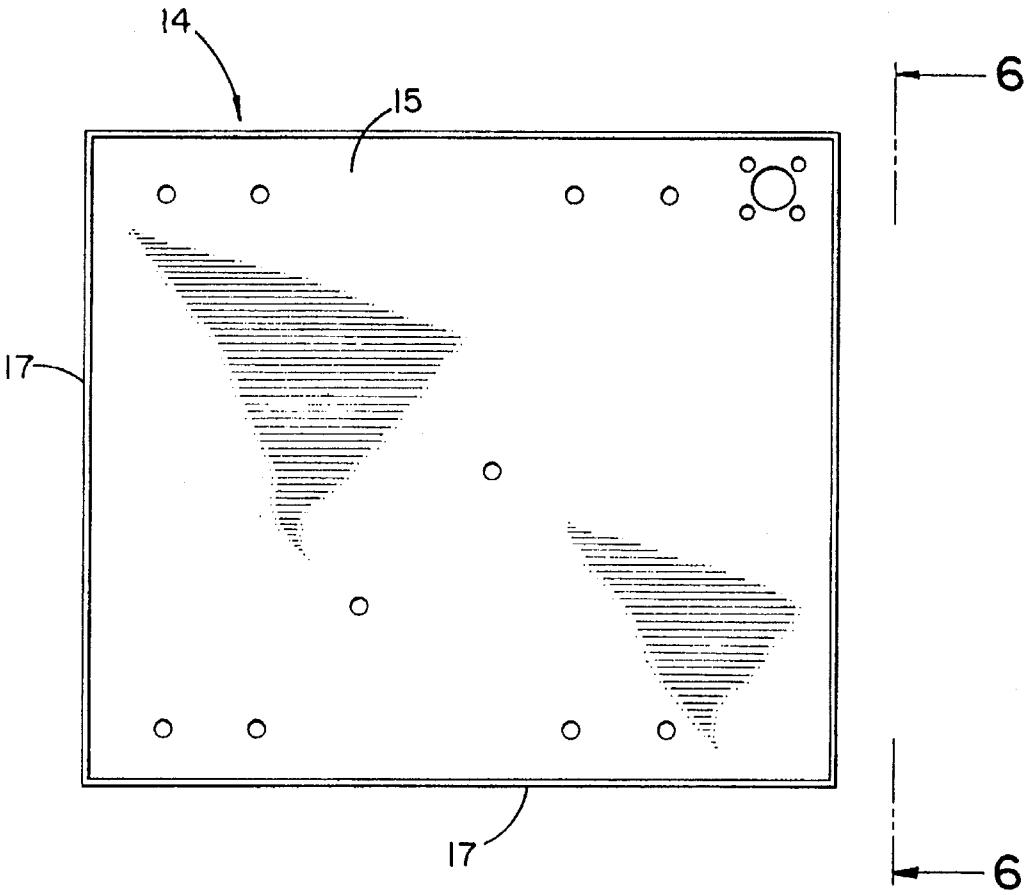
FIG. 5 is a top view of the reflector box used in the circularly polarized microcell antenna shown in FIG. 1, taken along line 5—5 of FIG. 6.
Figure 7:
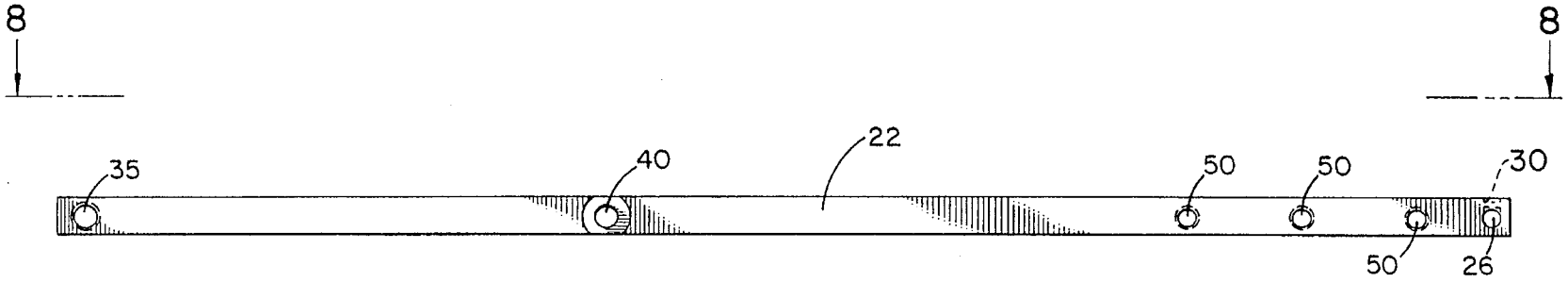
FIG. 7 is a bottom view of the conductor bar used in the circularly polarized microcell antenna shown in FIG. 1, taken along line 7—7 of FIG. 8.
Figure 8:
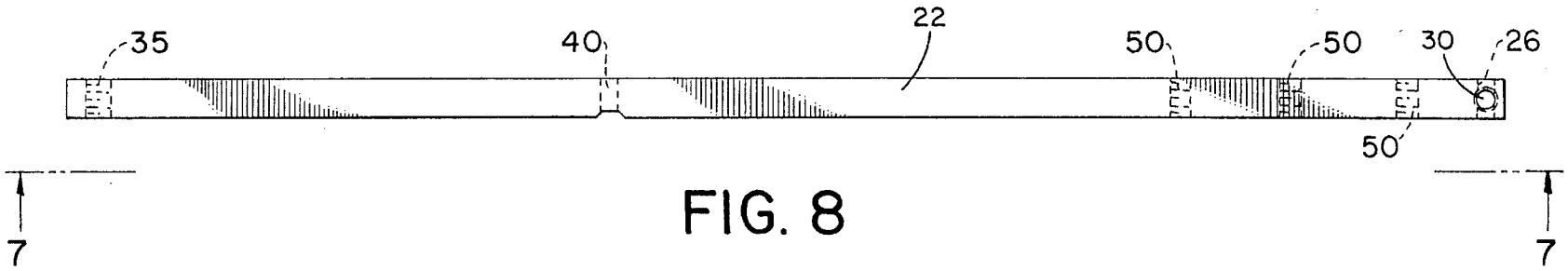
FIG. 8 is a side view of the conductor bar shown in FIG. 7, taken along line 8—8 of FIG. 7.
Figure 9:
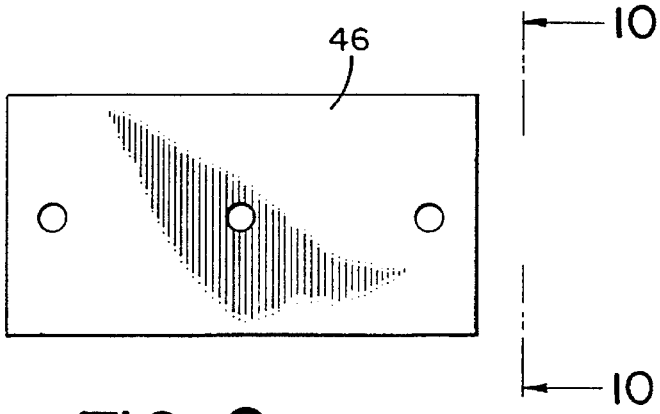
FIG. 9 is a top view of the trim element used in the circularly polarized microcell antenna shown in FIG. 1, taken along line 9—9 of FIG. 10.
Figure 10:
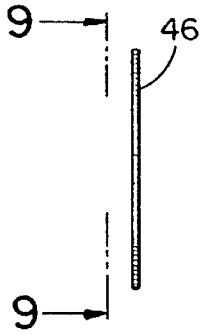
FIG. 10 is a side view of the trim element shown in FIG. 9, taken along line 10—10 of FIG. 9.

Referring to FIGS. 5 and 6, there is shown a top and a side view, respectively, of the reflector box 14 with the location of the mounting holes for the radome 12, the mounting brackets 18, the electrical connector 20, the conductor bar 22, and the second standoff 42 indicated. Referring to FIGS. 7 and 8, there is shown a bottom and a side view, respectively, of the conductor bar 22 with the location of the holes for the center conductor 24, the first standoff 36, and the trim element 46 indicated. Referring to FIGS. 9 and 10, there is shown a top and a side view, respectively, of the trim element 46 with the location of the mounting holes to the conductor bar 22 indicated.

Referring back to FIGS. 3 and 4, at the other end of both the first standoff 36 and the second standoff 42 there are secured a pair of dipole arms 52. These two dipole arms 52 are secured to their respective standoffs 36,42 with screws 54 that mate with the threaded holes 39 (see FIGS. 11 and 12) formed in the ends of the standoffs 36,42. These two dipole arms 52 form the primary dipole in the pair of crossed dipoles.

Secured to each dipole arm 52 forming the primary dipole is a third standoff 58 which in turn has one end of a phase loop element 56 secured thereto. Each third standoff 58 is secured to each primary dipole arm 52 with a screw 60, and each phase loop element 56 is secured to each third standoff 58 with a screw 62. Similar to the first standoff 36 and the second standoff 42, each third standoff 58 has threaded holes 64 (see FIGS. 11 and 12) formed therein which mate with the screws 60, 62. At this point it should be noted that the first standoff 36, the second standoff 42, the third standoffs 58, and, as will be described shortly, the fourth standoffs 66 only differ in their respective lengths. Thus, referring to FIGS. 11 and 12, all of the elements, except the exact lengths, of the first standoff 36, the second standoff 42, the third standoffs 58, and the fourth standoffs 66 are shown.

Referring again to FIGS. 3 and 4, at the other end of each phase loop element 56 there is secured a fourth standoff 66 which in turn has a secondary dipole arm 68 secured thereto. Each fourth standoff 66 is secured to each phase loop element 56 with a screw 70, and each secondary dipole arm 68 is secured to each fourth standoff 66 with a screw 72. It should be noted that each fourth standoff 66 is physically identical to each third standoff 58, although they have been designated differently for purposes of figure clarity. Thus, similar to the third standoff 58, each fourth standoff 66 has threaded holes 64 (see FIGS. 11 and 12) formed therein which mate with the screws 70, 72. It should also be noted that each secondary dipole arm 68 is physically identical to each primary dipole arm 52, although they have been designated differently for purposes of figure clarity. It should further be noted that these two secondary dipole arms 66 form the secondary dipole of the pair of crossed dipoles.

Figure 13:
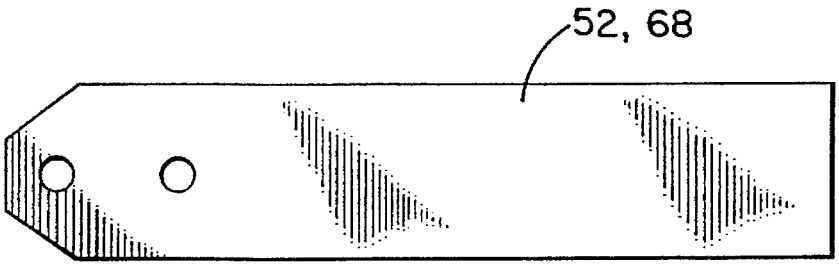
FIG. 13 is a top view of a dipole arm used in the circularly polarized microcell antenna shown in FIG. 1.
Figure 14:
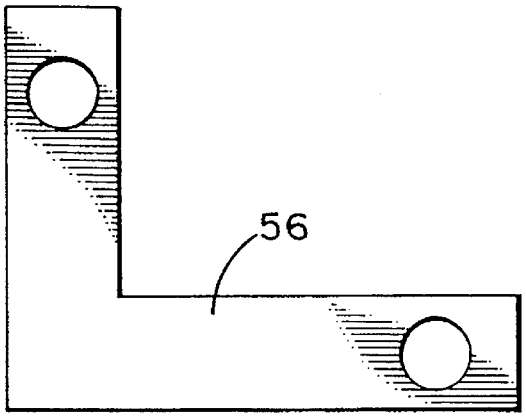
FIG. 14 is a top view of a phase loop element used in the circularly polarized microcell antenna shown in FIG. 1.
Figure 15:
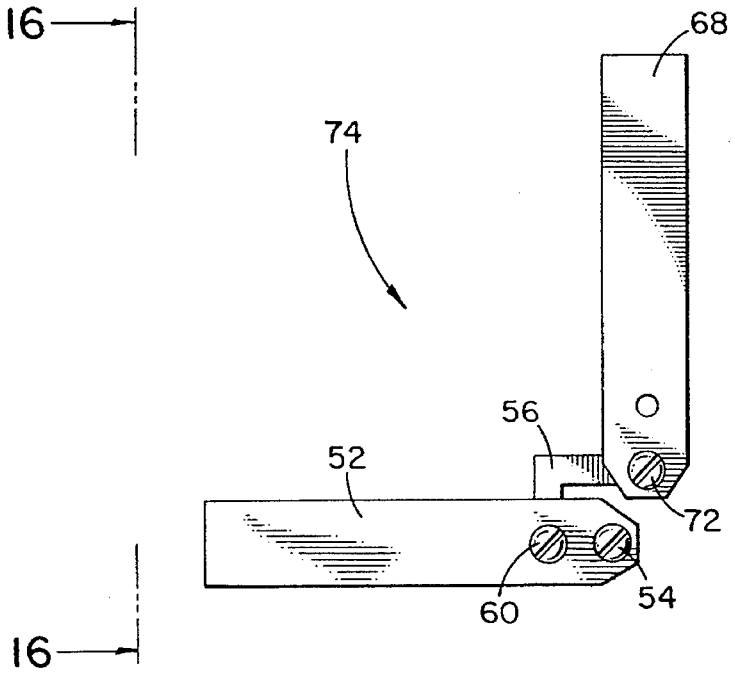
FIG. 15 is a top view of a dipole assembly used in the circularly polarized microcell antenna shown in FIG. 1, taken along line 15—15 of FIG. 16.
Figure 16:
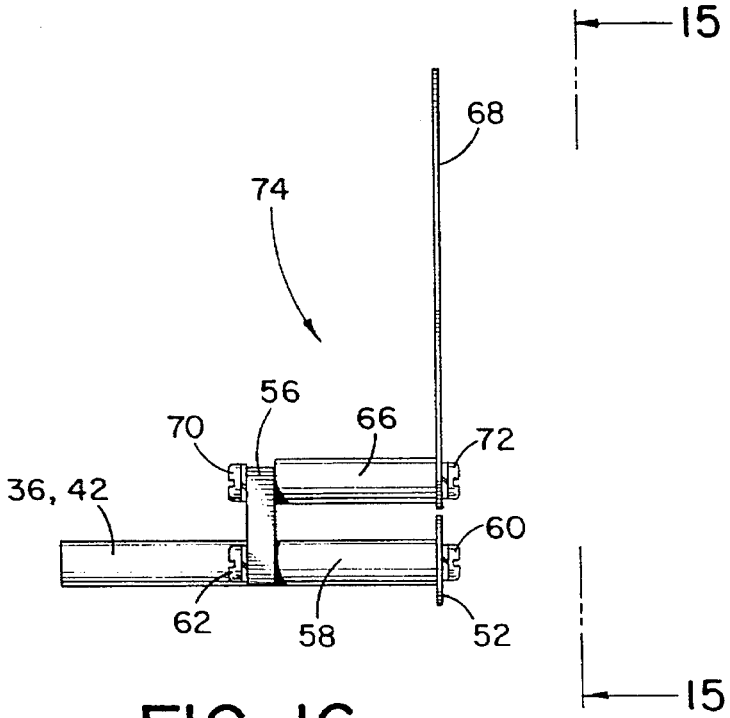
FIG. 16 is a side view of the dipole assembly shown in FIG. 15, taken along line 16—16 of FIG. 15.

Referring to FIG. 13, there is shown a top view of a primary 52 and a secondary 68 dipole arm with the location of the mounting holes to the standoffs 36,42,58,66 indicated. Referring to FIG. 14, there is shown a top view of a phase loop element 56 with the location of the mounting holes to the standoffs 58,66 indicated. Referring to FIGS. 15 and 16, there is shown a top and a side view, respectively, of a dipole assembly 74, of which there are two in the antenna 10, having a primary dipole arm 52, a secondary dipole arm 68, a third standoff 58, a phase loop element 56, a fourth standoff 66, mounting screws 54,60,62,70,72, and either a first standoff 36 or a second standoff 42. The length difference between the first standoff 36 and the second standoff 42 is such that all of the dipole arms 52,68 must lie in the same vertical plane. In other words, the second standoff 42 is longer than the first standoff 36 so as to compensate for their different mounting arrangements (ie. the first standoff 36 is mounted to the conductor bar 22, while the second standoff 42 is mounted to the reflector box 14).

The most critical aspect of the antenna 10 is the dimensioning of specific component parts, namely the dipole arms 52,68, the standoffs 36,42,58,66, and the phase loop elements 56. In order to correctly dimension these component parts, the center of the operating frequency range of the antenna 10 must be determined. In the case of cellular telephone communications, the operating frequency band ranges from 824 MHz to 894 MHz. Thus, the center of the operating frequency range is 859 MHz, which corresponds to a 13.7402 inch wavelength. With the center frequency, and thus the wavelength, known, the dimensions of the primary dipole arms 52 and the secondary dipole arms 68 can be readily determined. The use of one-half wavelength dipoles requires that the effective distance, or length, between the feed point on each dipole arm 52,68 and the end of each dipole arm 52,68 be one-quarter of the above said wavelength. By adding together the effective length of the two primary dipole arms 52 and by adding together the effective length of the two secondary dipole arms 68, a pair of crossed onehalf wavelength dipoles is established.

Each arm of the secondary dipole is fed by tapping the standing wave signal from a corresponding arm in the primary dipole. This signal is tapped through a pair of identical phasing loops, one for each arm, each comprising a phase loop element 56, a third standoff 58, and a fourth standoff 66. In order for the antenna 10 to achieve circular polarization, each phasing loop must provide a one-quarter wavelength delay, or a 90° phase shift, between the primary dipole arm 52 and the corresponding secondary dipole arm 68. Thus, the dimensions of each phasing loop must have an effective length of one-quarter of the above said wavelength. That is, the combined effective lengths of the phase loop element 56, the third standoff 58, and the fourth standoff 66 must be equal to one-quarter of the above said wavelength.

At this point it should be noted that the effective lengths of the phasing loops and the dipole arms 52,68 are largely dependent upon the current flow through these component parts, which is a function of component cross-sectional area and component geometry. Thus, the effective lengths of the phasing loops and the dipole arms 52,68 are often determined through experimental measurements rather than through pure physical dimensioning. It should also be noted that, although the circularly polarized microcell antenna 10 has been described herein as being used for cellular communications, the antenna concepts described herein may also be applied to other frequency bands with only dimensional changes being required.

With the dipole assembly design guidelines now fully described, a description for obtaining the component dimensions for one particular embodiment of a circularly polarized microcell antenna 10 for use in cellular telephone communications is set forth below. As previously described, the operating frequency band for cellular telephone communications ranges from 824 MHz to 894 MHz, with the center frequency at 859 MHz. This corresponds to a 13.7402 inch wavelength. With the effective length (inside dimension) of the phase loop element 56 chosen to be 1.248 inches, the effective length of both the third 58 and the fourth 66 standoffs have been determined to be 1.410 inches for a total of 4.068 inches, or 0.296 wavelengths. This actual effective wavelength of 0.296 wavelengths differs from a theoretical effective wavelength of 0.250 wavelengths, or one-quarter of the above said wavelength, due to the above-described component part dependence on current flow, which is a function of component cross-sectional area and component geometry. Thus, the actual effective wavelength of 0.296 wavelengths was determined by measuring the radiated phase from both dipoles in an actual circularly polarized microcell antenna 10 and adjusting the effective length of both the third 58 and the fourth 66 standoffs accordingly to achieve a 90° phase shift. The effective length of the dipole arms 52,68 have been similarly determined to be 3.564 inches, or 0.259 wavelengths. The dipole arms 52,68 are spaced off the conductor bar 22 and the reflector box 14 by the first standoff 36 and the second standoff 42, respectively. Also by measurement, the effective length of the first standoff 36 has been determined to be 2.871 inches, or 0.208 wavelengths, while the effective length of the second standoff 42 has been determined to be 3.281 inches, or 0.238 wavelengths. It should be noted that the difference between the effective length of the first standoff 36 and the effective length of the second standoff 42 is due to their different mounting arrangements.

With the above-described component part dimensions, the circularly polarized microcell antenna 10 will achieve circular polarization of radiated signals in the cellular telephone communications frequency band by providing a one-quarter wavelength delay, or a 90° phase shift, in each phasing loop.

Figure 17:
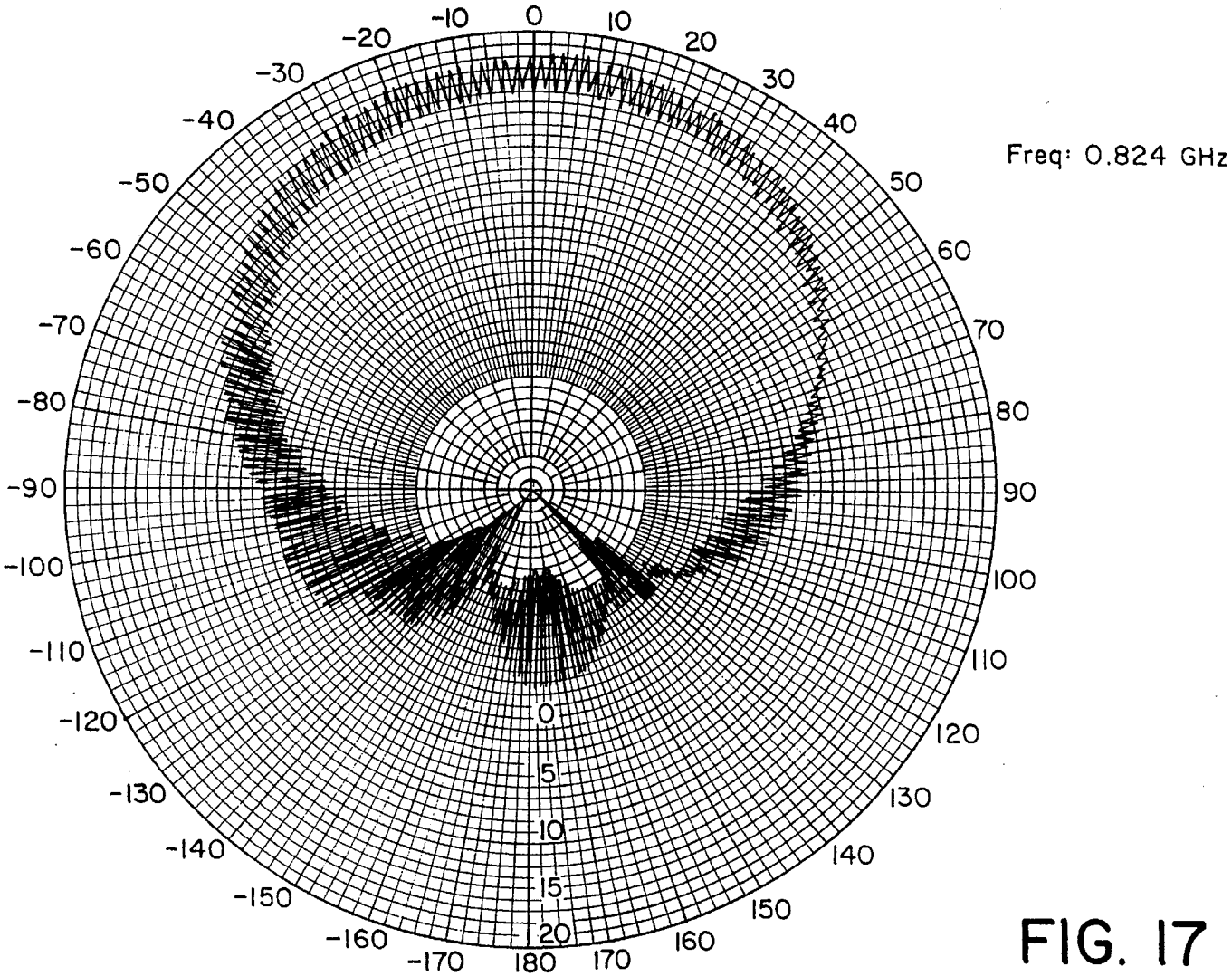
FIG. 17 shows a horizontal beamwidth pattern of the circularly polarized microcell antenna shown in FIG. 1, taken at 824 MHz.
Figure 18:
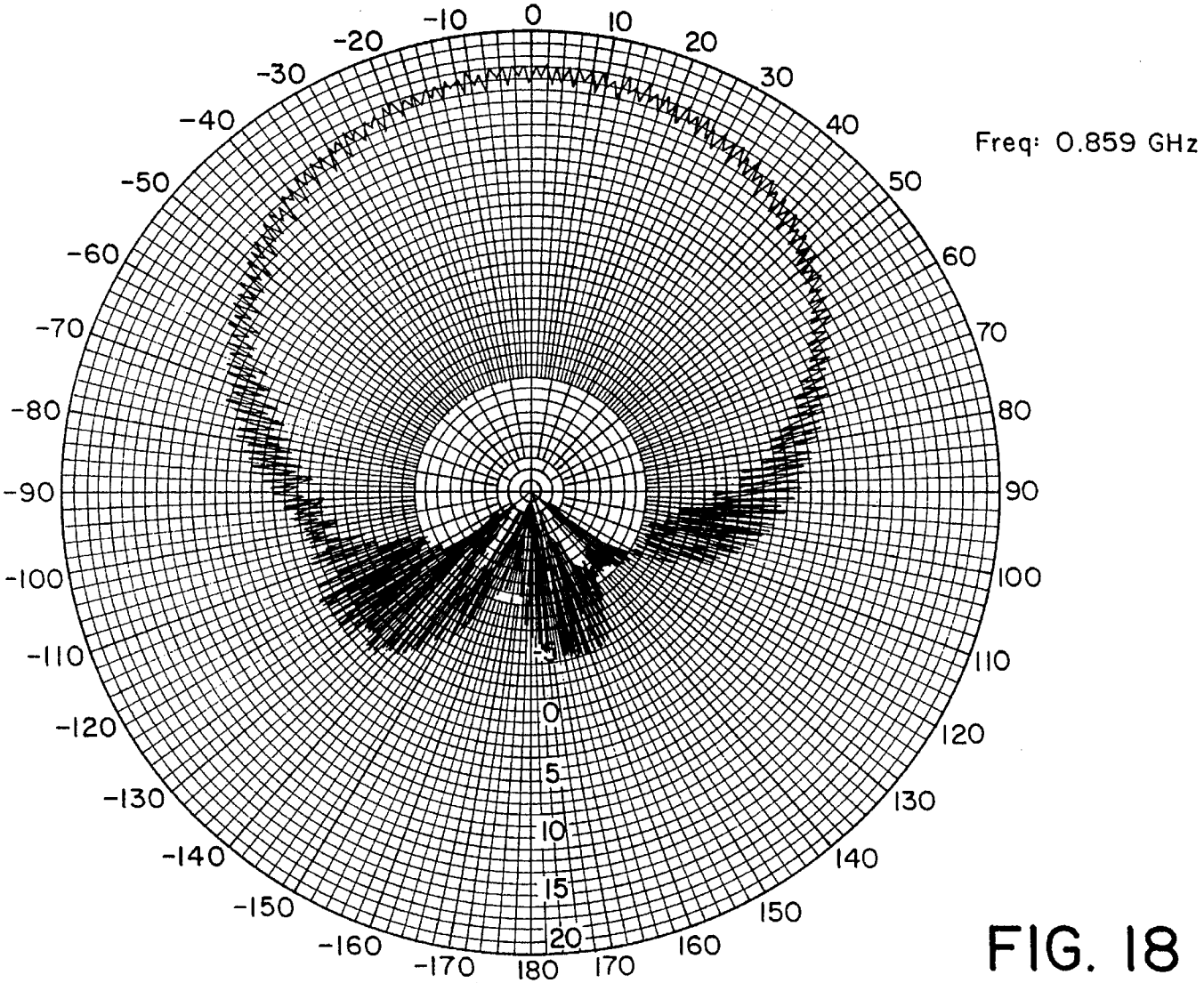
FIG. 18 shows a horizontal beamwidth pattern of the circularly polarized microcell antenna shown in FIG. 1, taken at 859 MHz.
Figure 19:
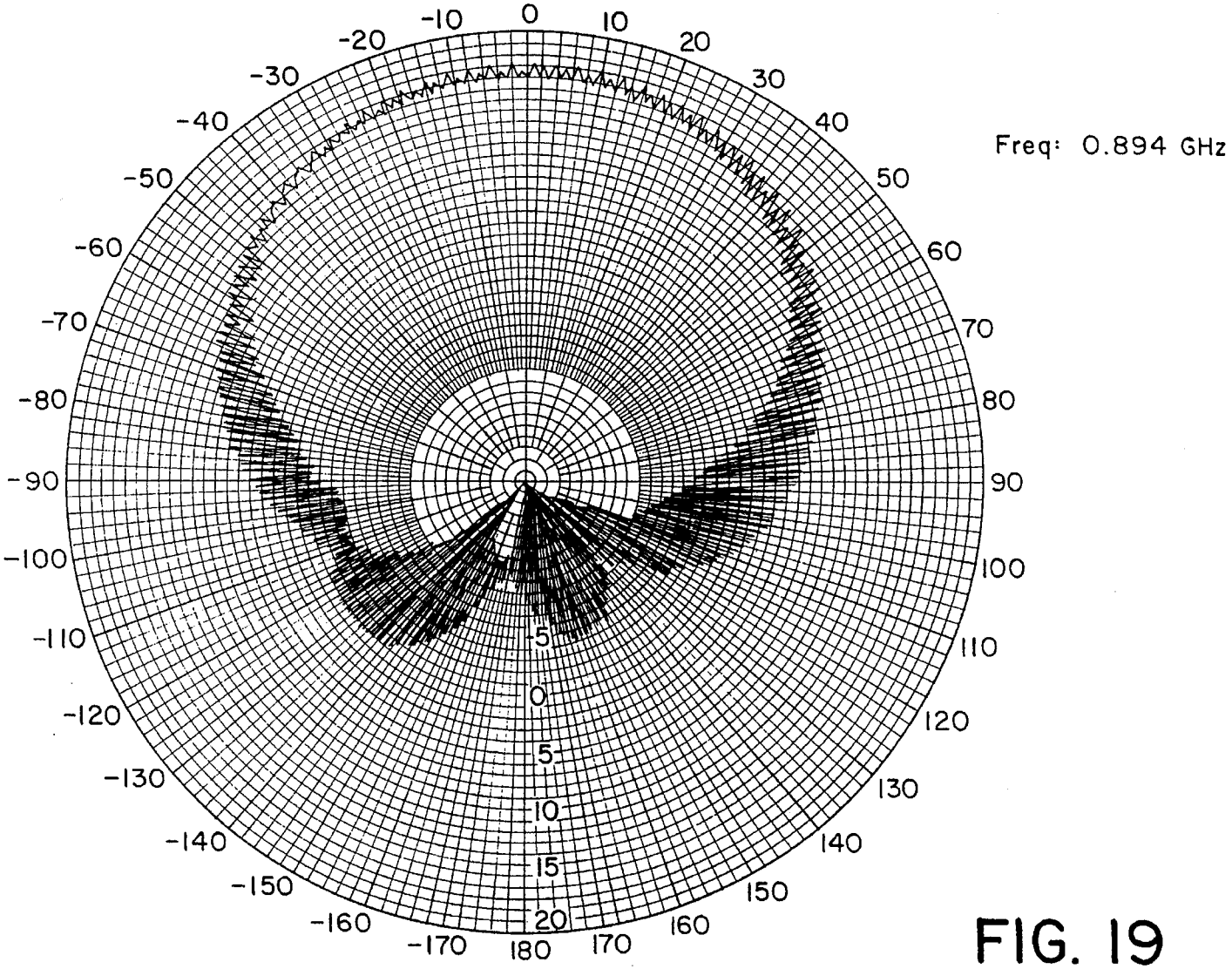
FIG. 19 shows a horizontal beamwidth pattern of the circularly polarized microcell antenna shown in FIG. 1, taken at 894 MHz.
Figure 20:
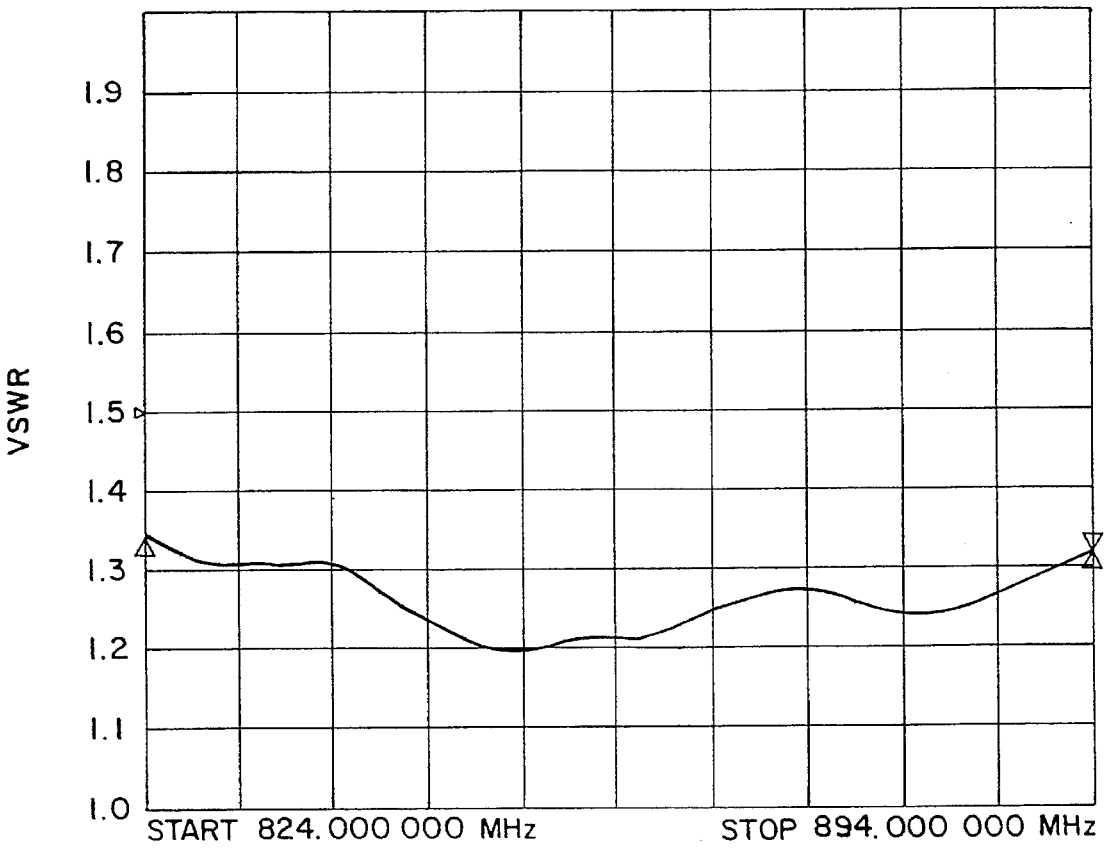
FIG. 20 is a graph of the voltage standing wave ratio of the circularly polarized microcell antenna shown in FIG. 1, taken over the range from 824 MHz to 894 MHz.

Referring to FIGS. 17, 18 and 19, measured horizontal beamwidth patterns of the circularly polarized microcell antenna 10 just described are shown at 824 MHz, 859 MHz, and 894 MHz, respectively. From these patterns, it can be seen that the 3 dB beamwidth of the antenna 10 over the cellular frequency band is approximately 75°. Referring to FIG. 20, a graph of the measured voltage standing wave ratio (VSWR) of the circularly polarized microcell antenna 10 just described is shown over the range from 824 MHz to 894 MHz. According to industry standards, a VSWR of under 1.5, which is demonstrated here, indicates a good impedance match. Thus, the circularly polarized microcell antenna 10 described herein can radiate circularly polarized electromagnetic signals having a horizontal beamwidth of 75 ° with a VSWR of less than 1.5 over the cellular frequency band.

With the preferred embodiment of the present invention circularly polarized microcell antenna 10 now fully described it can thus be seen that the primary objective set forth above is efficiently attained and, since certain changes may be made in the above described antenna 10 without departing from the scope of the invention, it is intended that all matter contained in the above description or shown in the accompanying drawings shall be interpreted as illustrative and not in a limiting sense.

What is claimed is:

1. A circularly polarized antenna (10) which is fed by a single feed-line for radiating circularly polarized electromagnetic energy therefrom, said antenna comprising:

an electrically conductive housing (12) having a base and a peripheral side wall extending upward therefrom for reflecting electromagnetic energy from therewithin;

an electrical connecter (20) having an electrical conductor (24) surrounded by an electrically grounded shell, said shell being mounted to said housing (12) such that an electrical connection is made therebetween, said antenna being connected to the single feed-line by said electrical connector (20);

a conductor bar (22) electrically connected to said electrical conductor (24) at a first end and to said housing (12) at a second end such that a standing wave may be generated therein; and a radiating structure including:

a first dipole assembly having a first primary dipole arm (52) and a first secondary dipole arm (68) electrically connected via a first phasing loop (56) for imposing a 90° phase shift therebetween, said first primary dipole arm (52) being mounted to said conductor bar (22) so that an electrical connection is made therebetween and said first phasing loop (56) physically elevating said first secondary dipole arm (68) above said base; and a second dipole assembly having a second primary dipole arm (52) and a second secondary dipole arm (68) electrically connected via a second phasing loop (56) for imposing a 90° phase shift therebetween, said second primary dipole arm (52) being mounted to said housing (12) so that an electrical connection is made therebetween and said second phasing loop (56) physically elevating said second secondary dipole arm (68) above said base;

wherein said first primary dipole arm (52) is a positively charged dipole arm of a one-half wavelength primary dipole and said second primary dipole arm (52) is a negatively charged dipole arm of said one-half wavelength primary dipole, wherein said first secondary dipole arm (68) is a positively charged dipole arm of a one-half wavelength secondary dipole and said second secondary dipole arm (52) is a negative charged dipole arm of said one-half wavelength secondary dipole, and whereby said radiating structure is fed by the single feed-line such that said positively and negatively charged dipole arms of said primary dipole are fed by the single feed-line via said conductor bar (22) and said housing (12), respectively, and said positively and negatively charged dipole arms of said secondary dipole are respectively fed by said positively and negatively charged dipole arms of said primary dipole via said first and second phasing loops, respectively.

2. The antenna (10) as defined in claim 1, further comprising a trim element (46) electrically connected to said conductor bar (22) for impedance matching said housing (12), said conductor bar (22), said first dipole assembly, and said second dipole assembly to said electrical connector (20).

3. The antenna (10) as defined in claim 2, wherein said trim element (46) is mounted to said conductor bar (22).

4. The antenna (10) as defined in claim 3, wherein said trim element (46) is made of is made of an electrically conductive material.

5. The antenna (10) as defined in claim 1, wherein said housing (12) is made of an made of an electrically conductive material.

6. The antenna (10) as defined in claim 1, wherein said electrical connector (20) is a coaxial connector having a center conductor (24) surrounded by an electrically grounded shell.

7. The antenna (10) as defined in claim 1, wherein said conductor bar (22) is a microstrip line conductor.

8. The antenna (10) as defined in claim 7, wherein said conductor bar (22) is made of electrically conductive material.

9. The antenna (10) as defined in claim 1, wherein said first dipole assembly is mounted to said conductor bar (22) at a designated one-quarter wavelength location with respect to a standing wave attendant in said conductor bar (22).

10. The antenna (10) as defined in claim 9, wherein said first dipole assembly is mounted to said conductor bar (22) with a standoff (36) made of an electrically conductive material.

11. The antenna (10) as defined in claim 1, wherein said first phasing loop (56) has an effective length of one-quarter of a wavelength with respect to a standing wave attendant in said conductor bar (22).

12. The antenna (10) as defined in claim 11, wherein said first phasing loop (56) is comprised of a pair of standoffs (58,66) and a phase loop element (56), all of which are made of an electrically conductive material.

13. The antenna (10) as defined in claim 1, wherein said first primary dipole arm (52) and said first secondary dipole arm (68) each have an effective length of one-quarter of a wavelength with respect to a standing wave attendant in said conductor bar (22).

14. The antenna (10) as defined in claim 13, wherein said first primary dipole arm (52) and said first secondary dipole arm (68) are both made of an electrically conductive material.

15. The antenna (10) as defined in claim 1, wherein said second dipole assembly is mounted to said housing (12) at a designated one-quarter wavelength location with respect to a standing wave attendant in said conductor bar (22).

16. The antenna (10) as defined in claim 15, wherein said second dipole assembly is mounted to said housing (12) with a standoff (42) made of an electrically conductive material.

17. The antenna (10) as defined in claim 1, wherein said second phasing loop (56) has an effective length of one-quarter of a wavelength with respect to a standing wave attendant in said conductor bar (22).

18. The antenna (10) as defined in claim 17, wherein said second phasing loop (56) is comprised of a pair of standoffs (58,66) and a phase loop element (56), all of which are made of an electrically conductive material.

19. The antenna (10) as defined in claim 1, wherein said second primary dipole arm (52) and said second secondary dipole arm (68) each have an effective length of one-quarter of a wavelength with respect to a standing wave attendant in said conductor bar (22).

20. The antenna (10) as defined in claim 19, wherein said second primary dipole arm (52) and said second secondary dipole arm (68) are both made of an electrically conductive material.

* * * * *